US005347557A

United States Patent [19]

Operschall et al.

[11] Patent Number: 5,347,557

[45] Date of Patent: Sep. 13, 1994

[54] APPARATUS FOR DECONTAMINATING RADIOACTIVELY CONTAMINATED SURFACES

[75] Inventors: Hermann Operschall, Lauf; Karl-Heinz Hack, Kunreuth; Klaus Hengelhaupt, Nuermberg; Konrad Meier-Hynek, Herzogenaurach, all of Fed. Rep. of Germany

[73] Assignee: Siemens Aktiengesellschaft, Munich, Fed. Rep. of Germany

[21] Appl. No.: 34,689

[22] Filed: Mar. 19, 1993

[30] Foreign Application Priority Data

Mar. 3, 1993 [DE] Fed. Rep. of Germany ..... 4306631

[51] Int. Cl.[5] ..... G21C 19/42

[52] U.S. Cl. ..... 376/316; 376/310

[58] Field of Search ..... 376/309, 310, 316

[56] References Cited

U.S. PATENT DOCUMENTS

| | | | |
|---|---|---|---|
| 4,483,205 | 11/1984 | Bellaiche et al. | 376/310 |
| 4,800,063 | 1/1989 | Mierswa et al. | 376/316 |
| 4,867,941 | 9/1989 | Le Dantec | 376/316 |
| 4,910,823 | 3/1990 | Silverman | 376/316 |
| 4,959,146 | 9/1990 | Kristan | 376/310 |
| 4,980,120 | 12/1990 | Bowman et al. | 376/216 |

FOREIGN PATENT DOCUMENTS

| | | |
|---|---|---|
| 0018152 | 10/1980 | European Pat. Off. . |
| 3429700 | 4/1985 | Fed. Rep. of Germany . |
| 9118712 | 12/1991 | PCT Int'l Appl. . |

OTHER PUBLICATIONS

"Oberflächenbehandlung mittels Strahlmitteln", Dipl.-Ing. ETH I. Horowitz, vol. 1, 1982.

*Primary Examiner*—Daniel D. Wasil
*Assistant Examiner*—Frederick H. Voss
*Attorney, Agent, or Firm*—Herbert L. Lerner; Laurence A. Greenberg

[57] ABSTRACT

An apparatus decontaminates a radioactively contaminated surface region of a pipe, connector or vessel being open at one end, with a dry mechanical blasting medium. The apparatus includes a processing bell to be mounted on the open end of the pipe, connector or vessel. A flexible dustproof duct is connected to the processing bell. A retaining device protrudes into the duct and is movable from outside in the interior of the pipe, connector or vessel. A blasting head is disposed on the retaining device. A blasting system is connected to the blasting head and has a continuous circulation of the blasting medium.

20 Claims, 2 Drawing Sheets

APPARATUS FOR DECONTAMINATING RADIOACTIVELY CONTAMINATED SURFACES

Figure 1:
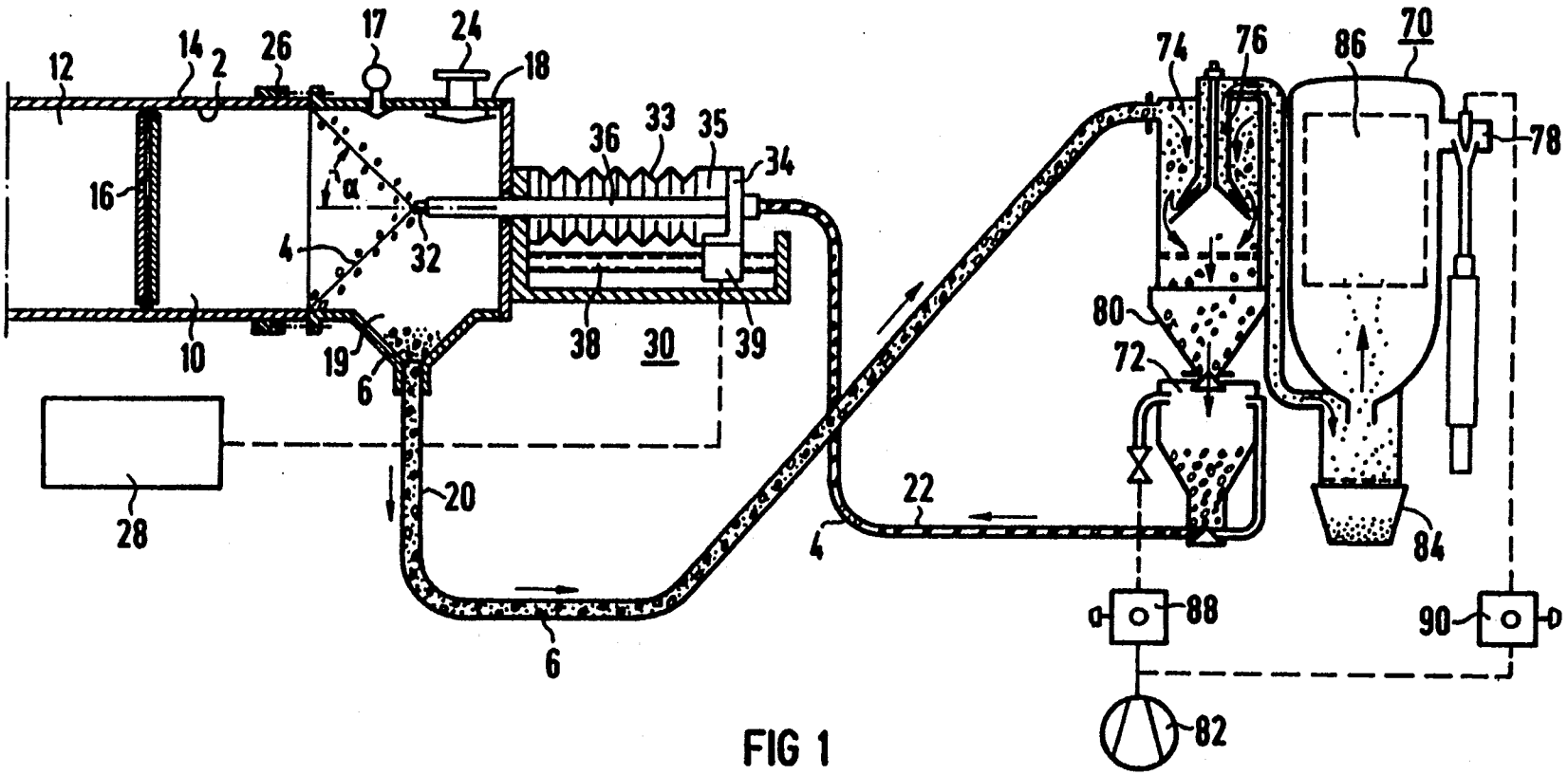

The invention relates to an apparatus for decontaminating radioactively contaminated surfaces, of the kind known from Published International Application WO 91/18712, for instance.

In repair work and checking of system parts in a nuclear system, radioactively contaminated surfaces can lead to a high radiation exposure to the repair personnel. In order to keep the radiation exposure as low as possible, it is necessary to decontaminate such surfaces before the repair work is carried out. When steam generators in nuclear power plants are replaced, for instance, it is necessary to decontaminate exposed inner surfaces of stationary loop lines before the weld edges are prepared and the actual welding work is performed.

In order to clean system parts in nuclear systems, methods are known in which the surfaces of the objects to be cleaned are treated with a blasting medium. The blasting medium blown against the objects leads to a removal of radioactive particles, which occur in the form of duct particles or aerosols and can spread out in the surrounding area.

In order to avert aerosol formation, wet blasting methods have therefore been proposed, in which the particles removed from the surface are bound to a component entrained with the blasting medium, so that aerosol formation is averted. Published European Application No. 0 018 152 B, for instance, discloses a wet blasting process in which the surface is exposed to a jet of water mixed with solid particles. The particles removed from the surface are then floated away together with the solid particles by the jet of water and can be caught in a container.

German Published, Non-Prosecuted Application DE 34 29 700 A, corresponding to U.S. Pat. No. 4,655,847, discloses a blasting method in which the surface is blasted with dry ice, to which a surfactant, such as ice particles or alcohol, is added. The surfactant is intended to prevent spreading of radioactive aerosols.

However, even in such known methods, aerosol formation cannot be averted entirely. Moreover, the effectiveness of the blasting treatment is reduced, because the actively abrasive blasting medium is only present in the overall blasting product in a low concentration. Moreover, a large quantity of radioactively contaminated sludge is produced, which can only be disposed of at major effort and expense.

Published International Application WO 91/18712 discloses equipment for decontaminating the inner surface of a pipe that is open at one end, for example a stationary loop line of a pressurized water reactor, once the steam generator has been disconnected, by using a dry sandblasting method in which a processing bell that forms a closed chamber which is seated on the open end together with a sealing disk, is inserted into the pipe.

In a structure intended for straight pipe ends, the processing bell includes a dustproof duct for a pipe that is axially displaceable in the interior of the pipe connector and is connected to a pressure line. A blasting medium that is delivered through the pressure line emerges from a blasting head disposed on the front end of the pipe and is spun against the surface to be decontaminated. The pipe and the blasting head form a manipulator, which can be axially displaced pneumatically along a guide rod fastened to the processing bell. However, using a slide seal in the processing bell and passing the pipe through this seal, is problematical because of the high incidence of blasting medium and dust.

In the case of curved pipe connectors, devices are provided according to Published International Application WO 91/18712 that include mechanical drive devices and movably supported rollers intended to move the manipulator forward inside the chamber. Once again, because of the high incidence of blasting medium and dust, it can cause undesired disruptions in operation inside the chamber and necessitates major construction effort and expense for building the manipulators. Moreover, a movable carriage cannot overcome hindrances in the pipe, such as steps resulting from changes in cross section, and the known structure having a central pipe adapted to the pipe curvature requires an expensive support on the bell, in order to be reliably capable of absorbing the moments exerted by the processing head.

It is accordingly an object of the invention to provide an apparatus for decontaminating radioactively contaminated surfaces located in the interior of a pipe, connector or container, which overcomes the hereinaforementioned disadvantages of the heretofore-known devices of this general type and which can be used with high operating safety yet is structurally inexpensive and can even be used in curved regions of a pipeline connector.

With the foregoing and other objects in view there is provided, in accordance with the invention, an apparatus for decontaminating a radioactively contaminated surface region of a pipe, connector or vessel being open at one end, with a dry mechanical blasting medium, comprising a processing bell to be mounted on an open end of a pipe, connector or vessel having a radioactively contaminated surface region to be decontaminated; a flexible dustproof duct connected to the processing bell; a retaining device protruding into the duct and being movable from outside in the interior of the pipe, connector or vessel; a blasting head disposed on the retaining device; and a blasting system being connected to the blasting head and having a continuous circulation of a dry mechanical blasting medium.

With the objects of the invention in view, there is also provided an apparatus for decontaminating a radioactively contaminated surface region located inside a pipe, connector or vessel being open on one end, with a dry mechanical blasting medium, comprising a processing bell to be mounted on an open end of a pipe, connector or vessel having a radioactively contaminated surface region to be decontaminated; a manipulator disposed on the processing bell; a flexible duct mounted on the processing bell; a retaining device protruding into the processing bell, being sealed off from the outside in a dustproof manner and being movable from the outside by the flexible duct; the manipulator having a blasting head being disposed on the retaining device and being movable in the interior of the pipe, connector or vessel; a blasting system having a closed circulation of a dry mechanical blasting medium, being closed off from the outside in a dustproof manner and having a pressure tank for operating the blasting system with compressed gas; a pressure line connected between the blasting system and the blasting head; and a suction line connected between the interior of the pipe, connector or container and the blasting system.

Since the motion of the blasting head is effected through a retaining device that is movable from outside through a flexible seal, expensive and vulnerable slide seals or vulnerable bearings for rollers or wheels that are movable inside the processing space exposed to the mixture of blasting medium and dust, are no longer necessary. The entire driving mechanism can be disposed outside this processing space. This considerably reduces the vulnerability to malfunction.

In accordance with another feature of the invention, the blasting system includes a filter for separating material removed by suction into two fractions having differing particle size distributions and for continuously delivering one of the fractions having a larger mean particle size to the pressure tank.

Since the surface region to be decontaminated is closed off from the outside in a dustproof manner during the blasting treatment by the processing bell and the flexible, dustproof duct, and since a blasting system being operated with compressed gas and being sealed off from the outside in a dustproof manner is used, spreading of radioactive aerosols into the surroundings is prevented. Due to the recovery of blasting medium that is carried out in the blasting system, the quantity of resultant radioactively contaminated waste is also reduced, and its activity is concentrated.

The blasting treatment is preferably carried out at a negative pressure prevailing inside the processing bell. This is achieved by adjusting the suction flow to a higher value than the compressed gas flow. Since when there is a negative pressure prevailing in the chamber, any possible leaks always produce an oriented flow into the chamber interior, contamination is prevented from escaping to the outside from the chamber through any possible leaks at the seals or ducts.

The blasting treatment preferably includes two method steps. In a first method step, blasting is performed with an angular blasting medium, such as corundum having a particle size of from 100 to 300 $\mu$m, in order to generate a decontamination effect by surface removal. What is removed is essentially the oxide film, which is the carrier of the radioactive contamination. The depth of removal required for effective decontamination is approximately 5 to 15 $\mu$m. In a second method step, blasting is then performed with a spherical blasting medium, such as glass, stainless steel or nickel alloys, in order to attain smoothing of the surface.

When the inner wall surface of a pipe connector that is joined to a pipeline and is open at one end is decontaminated, a sealing element is introduced into the pipeline in order to seal off the pipeline from the pipe connector. This prevents the spreading of radioactive aerosols and blasting medium into the interior of the pipeline.

Sealing off the pipe or container to be treated is carried out by means of a processing bell that can be seated in a dustproof manner on the open end. In accordance with another feature of the invention, the processing bell has a vent opening formed therein being provided with a filter. This feature prevents the buildup of an overly high overpressure in the chamber and retains contamination at the filter in the event that the blasting system is operated incorrectly, such as if the suction and compression gas flows are incorrectly set.

In accordance with a further feature of the invention, an axially displaceable pipe joined to the pressure line is provided as the movable retaining device for the blasting head, and a bellows that surrounds part of the pipe is provided as the flexible sealing duct or element.

The advantage of a manipulator that can be displaced in a straight line and in which the blasting head is located at the end of a rectilinear pipe, is that the drive elements, such as a motor and gears, that are necessary for the axial feed, can be disposed outside the blasting chamber where they are readily accessible. The inner surface of the container or pipe also has no influence in terms of its curvature, quality, diameter tolerances, conicity, and cast structure, upon the movement behavior of the manipulator. The outcome of decontamination is little affected. Moreover, the same manipulator can be used for blasting pipes having different rated widths. To that end, the processing bell need merely be adapted accordingly. Moreover, even pipes with steps in their diameter, such as widened or narrowed segments, can be blasted. Due to the good adaptability the pipes of various rated widths and the good decontamination, time is saved both in installation and in the decontamination treatment, which accordingly leads to a reduced radiation dose to personnel.

In accordance with an added feature of the invention, in an embodiment which is suitable for use with curved pipes or connectors, the processing bell is curved and has a curvature which is the opposite of the curvature of the pipe or connector, so that an angle is brought about between the end surface facing away from the open end of the pipe or connector and the end surface of the pipe or connector. This provision enables the use of a blasting head that is only axially displaceable even in curved regions of a pipe or connector. In accordance with yet another feature of the invention, the processing bell includes a cylindrical part and a curved adapter ring.

In accordance with yet a further feature of the invention, there is provided a rotatably supported spindle for axial displacement of the retaining pipe.

In accordance with yet an added feature of the invention, the blasting head includes at least one blast nozzle being rotatable about a feed direction.

In accordance with a concomitant feature of the invention, the manipulator includes a blasting head having blast nozzles which are disposed in such a way that the emergence of the blasting medium takes place at an angle relative to the feed direction. This angle of inclination is preferably between 30° and 60°, and in particular is approximately 45°. Moreover, the blasting nozzles may be disposed in such a way that the outlet direction of the blasting medium is inclined by 45° from the radial direction.

Other features which are considered as characteristic for the invention are set forth in the appended claims.

Although the invention is illustrated and described herein as embodied in an apparatus for decontaminating radioactively contaminated surfaces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
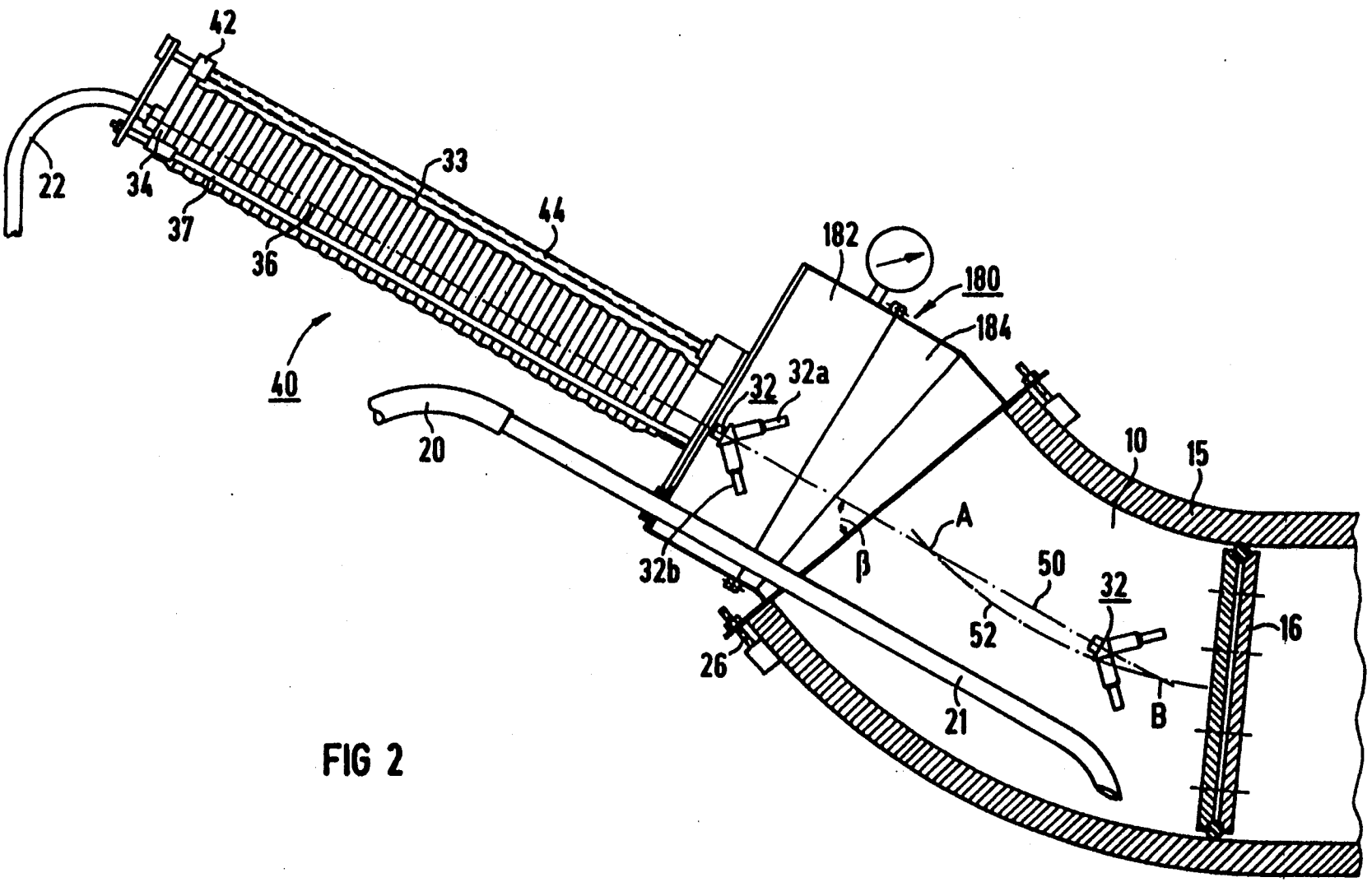

FIG. 1 is a diagrammatic and schematic circuit diagram of an exemplary embodiment of an apparatus according to the invention; and FIG. 2 is a fragmentary, partly sectional view of an advantageous feature of the invention, having a manipulator adapted for cleaning an inner wall surface of a curved pipe connector.

Referring now to the figures of the drawing in detail and first, particularly, to FIG. 1 thereof, there is seen a mechanical blasting treatment device that is provided for decontaminating a surface region 2 located in the interior of a pipe connector 14 belonging to a pipeline 12, which may be a stationary loop line, for example. For that purpose, the surface region 2 is exposed to dry blasting medium 4 emerging from a blasting head 32. The blasting treatment takes place in a chamber 10 that closes off the surface region 2 of the pipe connector 14 to be decontaminated, from the exterior and from the reactor system in dustproof fashion. In order to prevent the spreading of blasting medium and dust into the reactor system, a sealing disk 16 is inserted into the pipeline 12 connected to the reactor system. A processing bell 18 is mounted by a seal on the end surface of the pipe connector 14 and is fixed with the aid of a clamping ring 26 encompassing the pipe connector 14. A flexible dustproof duct or sealing element in the form of a bellows 33 forms a chamber 35 that is dustproof with respect to the outside. Mounted on the processing bell 18 is a manipulator 30 that contains a retaining device in the form of a pipe 36 inside the chamber 35 which protrudes into the processing bell 18. The chamber 35 is joined to the processing bell 18 in a dustproof manner with respect to the outside. One end of the pipe or tube 36 protruding into the processing bell 18 has the blasting head 32 and its other end is fixed in a flange 34 of the bellows 33, where it is connected to a pressure line 22 carrying the blasting medium 4.

The flange 34 jointly supports the bellows 33 and the pipe 36 on a drive mechanism 39, which can be displaced along a horizontal spindle 38, so that the pipe 36 can be driven axially into the pipe connector 14, while simultaneously reducing the volume of the chamber 35 formed by the bellows 33. The motion of the pipe 36 is remotely controlled by a control device that is provided with reference numeral 28 in the drawing. Instead of a spindle drive, a drive that has a rack, a chain, a belt, a cable, or a rod with a pneumatic piston, may be provided.

Since the bellows 33 that is dustproof from the outside is mounted in a dustproof manner on the processing bell, the use of a dustproof slide bearing of the pipe 36 at a duct through the processing bell, is no longer necessary.

The bellows 33 is formed of an elastic material, preferably rubber or plastic, and is additionally reinforced with steel rings, because of the negative pressure prevailing in its interior.

The processing bell 18 also includes an outlet funnel 19 for receiving an incident mixture 6 of blasting medium and dust. The outlet funnel 19 communicates through a duct with a suction line 20, through which the mixture 6 being formed of blasting medium and dust is removed by suction.

During the blasting treatment, a negative pressure prevails in the chambers 10 and 35, so that an escape of dust into the space located outside these chambers 10 and 35 can be virtually precluded. In order to monitor the pressure in the chambers 10, 35, a pressure gauge 17 is provided. The processing bell 18 also contains a vent opening 24 which is provided with a filter and which prevents the buildup of an overly high pressure difference between the chambers 10, 35 and the space outside and traps any contamination, in the event of incorrect operation of the blasting system.

Both the delivery of the blasting medium 4 and the removal by suction of the mixture 6 of blasting medium and dust take place in a blasting system 70 with a closed circulation of blasting medium. Such blasting systems are known, for instance from the manual by I. Horowitz entitled: "Oberflächenbehandlung mittels Strahlmitteln" [Surface Treatment by Means of Blasting Mediums], Vol. 1, 2nd ed., Essen 1982, pages 278 and 279. To that end, the suction line 20 communicates with a suction-type removal device 74, which contains a filter 76 with which the blasting medium is filtered out of the suction flow. In the exemplary embodiment of the drawing, a cyclone is provided as the filter 76, and in it the mixture 6 of blasting medium and dust is separated into two fractions having a different mean particle size. The fraction having the larger mean particle size is substantially formed of the blasting medium 4, and by the action of gravity it drops into a supply container 80, from which it is delivered to a pressure tank 72 through a drop valve.

The pressure tank 72 communicates with the pressure line 22 and it communicates with a compressor 82 through a control valve 88. The recovered blasting medium 4 is fed through a delivery valve disposed in the bottom of the pressure tank 72, into the pressure line 22 and it is delivered to the manipulator 30. In order to produce the negative pressure required in the suction device 74, both for removing the mixture 6 of blasting medium and dust by suction, and for operating the cyclone, a compressed-gas-operated injector 78 is provided, which likewise communicates with the compressor 82 through an adjusting valve 90.

Located between the cyclone 76 and the injector 78 is a filter container 86, in which the compressed gas which has been aspirated by the injector and still carries the radioactive dust after leaving the cyclone, is cleaned by means of an aerosol filter before it emerges into the space outside. The dust carried onward from the cyclone to the filter container 86, which essentially is formed of small-sized particles, contains both the radioactively contaminated particles removed from the surface 2 and crushed particles of the blasting medium. Widening the cross section at the entrance to the filter container produces a lowering of the flow velocity, and the dust settles due to the influence of gravity in a dust container 84. The dust precipitated out of the suction flow is highly radioactive and can be taken elsewhere for further disposal by removing the dust container 84. Due to the recovery of the blasting medium 4, the incident dust quantity is low and its disposal is made easier.

In the exemplary embodiment of a manipulator 40 as shown in FIG. 2, the rearward flange 34 of the bellows 33, which faces away from a processing bell 180, is supported on a travelling or creep nut 42, which can be shifted back and forth along a rotatable spindle 44 disposed next to the bellows 33. In this way, the nut 42 brings about a linear feed of the pipe 36 that is fixed on the end of the bellows 33 and extends in its interior. The spindle 44 is driven through gears and a pneumatic or electric motor and is remotely controlled by the control device 28 shown in FIG. 1.

In order to increase stability, the bellows 33 is guided not only on the flange 34 but also on a guide rod 37 disposed outside the bellows.

In the example shown in the drawing, the manipulator 40 is mounted by means of the processing bell 180 on a curved pipe connector 15. In the drawing, reference numeral 50 indicates an axis along which the blasting head 32 moves inside the processing bell 180 and inside the pipe connector 15. This axis 50 intersects a center line 52 of the curved pipe connector 15 at two points A and B, which are preferably located inside the chamber 10 formed by the sealing ring 16 and the end surface of the connector 15. The blasting head 32 thus enters the pipe connector 15 eccentrically and is accordingly located below the center line 52 of the pipe connector 15, in a first motion segment. In a middle motion segment, the blasting head is located inside a circle defined by this center line 52, and then intersects that line again before it reaches the sealing disk 16. As a result, despite the curvature of the pipe connector 15, it is assured that the blasting head 32 will always move within the vicinity of the center line 52.

The axis 50 thus intersects the end surface of the pipe connector 15 inside its center and is additionally inclined relative to this surface by an acute angle $\beta$. In order to achieve this kind of displacement of the blasting head 32, the processing bell 180 is curved with a curvature which is the opposite of the curvature of the pipe connector 15, so that the processing bell 180 and the pipe connector 15 form an S. The term "curvature" should be understood herein to mean that the end surface of the processing bell 180, with which it is mounted on the open end of the pipe connector 15, is inclined relative to the end surface of the processing bell 180 on which the manipulator 40 is fixed. In the exemplary embodiment shown in the drawing, a steady curvature is not necessary. The curvature of the processing bell 180 may also be the result of a plurality of individual segments, which themselves are not curved but are assembled at an acute angle. In the preferred embodiment shown in FIG. 2, the processing bell 180 is in two parts and includes a cylindrical part 182 as well as a curved adapter ring 184, which can be used to suit the particular curvature conditions of a pipe connector to be processed.

A suction tube 21 connected to the suction line 20 is also passed through the processing bell 180. The suction tube 21 is curved at its open end and leads into the vicinity of the lowermost point of the pipe connector 15, which is located at the sealing disk 16.

It can also be seen in the drawing that the blasting head 32 includes two blast nozzles **32*a*, 32*b*, which are disposed in such a way that the emergence of the blasting medium takes place at an incline relative to the feed direction. The angle of this inclination is between 30° and 60°, and in the example shown in the drawing it is approximately 45°. The blast nozzles 32*a*, 32*b* are disposed rotatably and offset from the axis 50 at the end of the pipe 36, so that the blasting medium emerging from them exerts a torque upon the blasting head 32 and causes a rotation of the blast nozzles 32*a*, 32*b* about the axis 50**.

We claim:

1. An apparatus for decontaminating a radioactively contaminated surface region of a pipe, connector or vessel being open at one end, with a dry mechanical blasting medium, comprising:

a processing bell to be mounted on an open end of a pipe, connector or vessel having a radioactively contaminated surface region to be decontaminated;

a flexible dustproof duct connected to said processing bell;

a retaining device protruding into said duct and being movable from outside in the interior of the pipe, connector or vessel;

a blasting head disposed on said retaining device; and a blasting system being connected to said blasting head and having a continuous circulation of a dry mechanical blasting medium.

2. The apparatus according to claim 1, wherein said blasting system includes a filter for separating material removed by suction into two fractions having differing particle size distributions and for continuously delivering one of the fractions having a larger mean particle size to said pressure tank.

3. The apparatus according to claim 2, wherein said processing bell has a vent opening formed therein with a filter.

4. The apparatus according to claim 2, wherein said retaining device on which said blasting head is disposed is a retaining pipe being axially displaceable and communicating with said pressure line.

5. The apparatus according to claim 4, wherein said processing bell has a course of curvature being opposite a curvature of the pipe or connector.

6. The apparatus according to claim 5, wherein said processing bell includes a cylindrical part and a curved adapter ring.

7. The apparatus according to claim 4, wherein said flexible duct is a bellows surrounding part of said retaining pipe.

8. The apparatus according to claim 7, including a rotatably supported spindle for axial displacement of said retaining pipe.

9. The apparatus according to claim 8, wherein said blasting head includes at least one blast nozzle being rotatable about a feed direction.

10. The apparatus according to claim 9, wherein said blast nozzle supplies the blasting medium at an incline relative to the feed direction.

11. An apparatus for decontaminating a radioactively contaminated surface region located inside a pipe, connector or vessel being open on one end, with a dry mechanical blasting medium, comprising:

a) a processing bell to be mounted on an open end of a pipe, connector or vessel having a radioactively contaminated surface region to be decontaminated;

b) a manipulator disposed on said processing bell;

c) a flexible duct mounted on said processing bell;

d) a retaining device protruding into said processing bell, being sealed off from the outside in a dustproof manner and being movable from the outside by said flexible duct;

e) said manipulator having a blasting head being disposed on said retaining device and being movable in the interior of the pipe, connector or vessel;

f) a blasting system having a closed circulation of a dry mechanical blasting medium, being closed off from the outside in a dustproof manner and having a pressure tank for operating said blasting system with compressed gas;

g) a pressure line connected between said blasting system and said blasting head; and h) a suction line connected between the interior of the pipe, connector or container and said blasting system.

12. The apparatus according to claim 11, wherein said blasting system includes a filter for separating material removed by suction into two fractions having differing particle size distributions and for continuously delivering one of the fractions having a larger mean particle size to said pressure tank.

13. The apparatus according to claim 12, wherein said processing bell has a vent opening formed therein with a filter.

14. The apparatus according to claim 12, wherein said retaining device on which said blasting head is disposed is a retaining pipe being axially displaceable and communicating with said pressure line.

15. The apparatus according to claim 14, wherein said processing bell has a course of curvature being opposite a curvature of the pipe or connector.

16. The apparatus according to claim 15, wherein said processing bell includes a cylindrical part and a curved adapter ring.

17. The apparatus according to claim 14, wherein said flexible duct is a bellows surrounding part of said retaining pipe.

18. The apparatus according to claim 17, including a rotatably supported spindle for axial displacement of said retaining pipe.

19. The apparatus according to claim 18, wherein said blasting head includes at least one blast nozzle being rotatable about a feed direction.

20. The apparatus according to claim 19, wherein said blast nozzle supplies the blasting medium at an incline relative to the feed direction.

* * * * *